US008578669B2

(12) United States Patent
Zohar

(10) Patent No.: US 8,578,669 B2
(45) Date of Patent: Nov. 12, 2013

(54) METHODS AND DEVICES FOR MAKING A BUILDING BLOCK FOR MORTAR-FREE CONSTRUCTION

(76) Inventor: Ron Zohar, Rehovot (IL)

( * ) Notice: Subject to any disclaimer, the term of this patent is extended or adjusted under 35 U.S.C. 154(b) by 0 days.

(21) Appl. No.: 13/108,016

(22) Filed: May 16, 2011

(65) Prior Publication Data

US 2012/0291383 A1 Nov. 22, 2012

(51) Int. Cl.
*E04C 2/52* (2006.01)

(52) U.S. Cl.
USPC ..... 52/220.1; 52/503

(58) Field of Classification Search
USPC ..... 52/220.1, 306, 308, 503, 505, 604, 605, 52/607, 220.3, 220.7
See application file for complete search history.

(56) References Cited

U.S. PATENT DOCUMENTS 2,115,264 A * 4/1938 Henderson ..... 52/306
2,205,730 A * 6/1940 Morgan ..... 52/204.1
4,041,670 A * 8/1977 Kaplan ..... 52/592.2
4,318,254 A * 3/1982 Stegmeier ..... 52/169.7
4,969,282 A * 11/1990 Eberhart ..... 40/545
5,038,542 A * 8/1991 Kline ..... 52/306
5,065,560 A * 11/1991 Yoder ..... 52/306
5,236,975 A * 8/1993 Sekine ..... 523/510
5,471,808 A * 12/1995 De Pieri et al. ..... 52/603
5,987,829 A * 11/1999 Fisher ..... 52/306
6,401,406 B1 * 6/2002 Komara ..... 52/127.3
6,944,998 B1 * 9/2005 King ..... 52/314
7,159,367 B1 * 1/2007 King ..... 52/314
7,395,999 B2 * 7/2008 Walpole ..... 249/33

* cited by examiner

*Primary Examiner* — Basil Katcheves

(57) ABSTRACT

The invention discloses devices and methods for making building blocks for construction that requires neither mortar nor additional internal or external finishing. A building block includes joining elements for attaching blocks from top to bottom as well as from side to side. Additionally, blocks have internal and external finishes that are complete. Thus, after construction of a structure, there is no additional need to paint, hang wallpaper or otherwise treat the outer and inner walls of the final structure.

10 Claims, 18 Drawing Sheets

200

METHODS AND DEVICES FOR MAKING A BUILDING BLOCK FOR MORTAR-FREE CONSTRUCTION

FIELD AND BACKGROUND OF THE INVENTION

The present invention, in some embodiments thereof, relates to methods and components for preparing a building block for mortar-free construction. In some embodiments, building blocks are described that have unique finishes and features for home, office, factory or other construction based on a single or plurality of pre-made blocks that together provide walls with complete internal and external finishes.

One of the most basic necessities form mankind is housing. People need a place to live and a home is oftentimes the biggest investment that an individual or family will ever make. Home construction varies throughout the world, though the basic requirements of keeping the elements out and allowing for successful living within are true everywhere.

While homes may be made from a wide range of materials, building blocks generally based on cement are still widely used in defining rooms within structures as well as houses themselves. While drywall is popular today in construction, external walls and rooms that have much moisture—like bathrooms—generally require stronger walls based on stone or blocks. Blocks are made through traditional methods and are generally joined through mortar or similar binding materials. Building blocks are generally several pounds each in weight and have no functionality beyond defining boundaries of or within a structure.

U.S. Pat. No. 4,903,453 to Newsom describes a construction method for fabricating structures and a system of building blocks utilized in the method. The blocks are hollow and may be skeletal and formed from heavy gauge strips or molded. They include at least two sub-assemblies joined by interconnecting webs with provisions for single subassemblies to square off wall edges. Each skeletal subassembly includes upper and lower frames joined together by a plurality of structural columns perpendicular to the planes of the upper and lower frames. The upper and lower frames are dimensioned to form interfitting male and female receptacles that permit the blocks to be interconnected. D-lance snap fit structures are provided in the upper and lower frames so that an assembly of blocks with structural integrity may be created by snapping together courses of blocks with each course staggered relative to the adjacent course U.S. Pat. No. 4,258,522 to Amaral teaches a system of construction blocks preferably from plastic having interlocking sides, tops, and bottoms which can be assembled with or without adhesive rather than mortar and which are strong, inexpensive, hollow, and lightweight.

U.S. Pat. No. 5,984,589 to Ciccarello describes a wall construction block for the construction of earth retaining walls includes a pair of spaced-part transverse pin receiving channels in the end walls of the block and disposed parallel to one another along respective longitudinal axis of the block which are parallel with a front lace of the block. The pin receiving channels extend transverse from a top surface to a bottom surface of the block and are of substantially uniform cross-section throughout. Arresting pin elements are received in sliding fit within some of the receiving channels and are retained captive therein. Elongated parallel grooves are provided on a top surface of the block and extend across the end walls and parallel to the front wall. One of the groove is aligned between a first set of the pin receiving channels and the other of the parallel grooves is offset a predetermined distance between the other set of pin receiving channels. When the blocks are disposed in rows one on top of one another, with the top wall of the block lacing upwards, the rows of blocks are arrested from transverse shifting by positioning arresting pin elements in selected ones of the sets of transverse pin receiving channels. The pins extend out of the bottom wall of the uppermost block and into a selected one of the pair of grooves in a top surface of the lower block.

U.S. patent application Ser. No. 11/305,396, to Haener describes an interlocking block system consisting of a full block and a half block are installed mortar free with the internal cells filled with grout as required. The blocks must be laid in the upright position but may be rotated end to end as required for aesthetic reasons or to create an additional square internal cell. The blocks are supported by a tongue and groove engagement at the four external corners and four internal locking members that engage within the block on the course above. Knockout sections and relief areas are supplied for the installation of reinforcing bars. When the blocks are turned at a ninety degree angle to make a corner, the internal locking members engage in the square end cell of the block above equally as well as they do in a straight course of blocks.

Pat. No. 7,694,485 to Siener teaches a mortar-less interlocking building block for a building block system comprising a single light-weight block of the standard building block dimensions molded from plastic and configured to be separable into three-quarter, half and one-quarter sizes for accommodating prescribed to wall dimension lengths and openings, including a feature for building interconnecting right-angle walls.

The prior art generally describes blocks and methods for constructing structures using pre-made building blocks of various materials that do not include pre-made internal and external final finishes.

SUMMARY OF THE INVENTION

It is therefore a purpose of the present invention, in some embodiments, to describe methods and devices for building structures with a single or small set of unique building blocks that have all the features required for on-site complete construction and use as provided without any further action such as painting, wall-papering or adding siding. In some embodiments of the invention, hollow interiors of building blocks allow for passage of pipes, wires, and the like.

The invention includes a hollow block for the mortar-less construction of a building, wherein said block has a top side that includes a first joining feature, a bottom side including a complementary second joining feature, an outer side having a first finish, an inner side having a second finish, and an inner space amenable to the passage of infrastructure elements.

In one aspect of the block, the first joining feature is a plurality of joining features.

In another aspect of the block, the second joining feature is a plurality of joining features.

In another aspect of the block, the joining features include at least one strip of two-sided tape.

In another aspect of the block, the joining features include at least one male joining feature.

In another aspect of the block, the joining features include at least one female joining feature.

In another aspect of the block, the building is a house, room, office, factory, school, hospital, public structure, private building or room.

In another aspect of the block, there is additionally insulation placed inside the block.

In another aspect of the block, the infrastructure elements are selected from piping, wiring, cables, or telephone lines.

In another aspect of the block, the first finish is weatherproofed and selected from paint, wood, brick, aluminum siding, stone, glass, composite materials, metal.

In another aspect of the block, the second finish is selected from paint, wallpaper, stone, wood, brick, aluminum, glass, metal, composite materials, or drywall.

The invention additionally includes a method for building a structure without mortar, including the following: selecting a site for construction of a structure;

pouring concrete over at least a portion of the site of construction; placing a first plurality of building blocks in a straight line, wherein said line defines a wall of the structure; placing a second plurality of building blocks on the first plurality of building blocks, wherein the second plurality of building blocks are secured to the first plurality of building blocks; adding additional building blocks until a predetermined height of the wall has been reached; placing a closure element over the highest level of blocks so as to lock all blocks associated with the wall in place; building additional walls of the structure; and, completing construction of the structure, wherein the blocks are used in the construction of the internal and external walls of said structure.

In one aspect of the method, the building blocks are a plurality of building blocks with different structural, thermal, optical or aesthetic properties.

In another aspect of the method, the building blocks include building blocks with optically-clear sides that may serve as windows.

In another aspect of the method, the building blocks include blocks that may be used in building of a roof.

The invention also provides for a building block for mortarless and paint-less construction, wherein the block is made of a pre-painted lightweight polymer material and includes a plurality of elements for self-joining with another building block as well as a face that can be transiently removed for installation of infrastructure elements.

In one aspect of the building block, the building block includes spaces for passing through electrical wiring, pipes, tubes, cables and telephone lines.

In another aspect of the building block, the elements for self-joining allow for seamless contact between blocks.

In another aspect of the building block, the building block includes at least one male and at least one female joining element.

In another aspect of the building block, the building block is used for the construction of a home.

Unless otherwise defined, all technical and/or scientific terms used herein have the same meaning as commonly understood by one of ordinary skill in the art to which the invention pertains. "Plastic" as applied to materials used in construction of a building block may include any type of synthetic material, polymer, composite material or combinations of synthetic and natural materials. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced. It is noted that similar elements in various drawings will have the same number, advanced by the appropriate multiple of 100.

In the drawings:

FIGS. 8A-8B shows a schematic view of a building block according to the instant invention adapted for passage of wires, pipes or the like;

DESCRIPTION OF SPECIFIC EMBODIMENTS OF THE INVENTION

The present invention, in some embodiments thereof, relates the manufacture and use of building blocks, wherein said building blocks require no mortar for construction and are also prepared with internal and external finishes so as to obviate any requirement for painting or further manipulation post-construction.

Figure 1A:
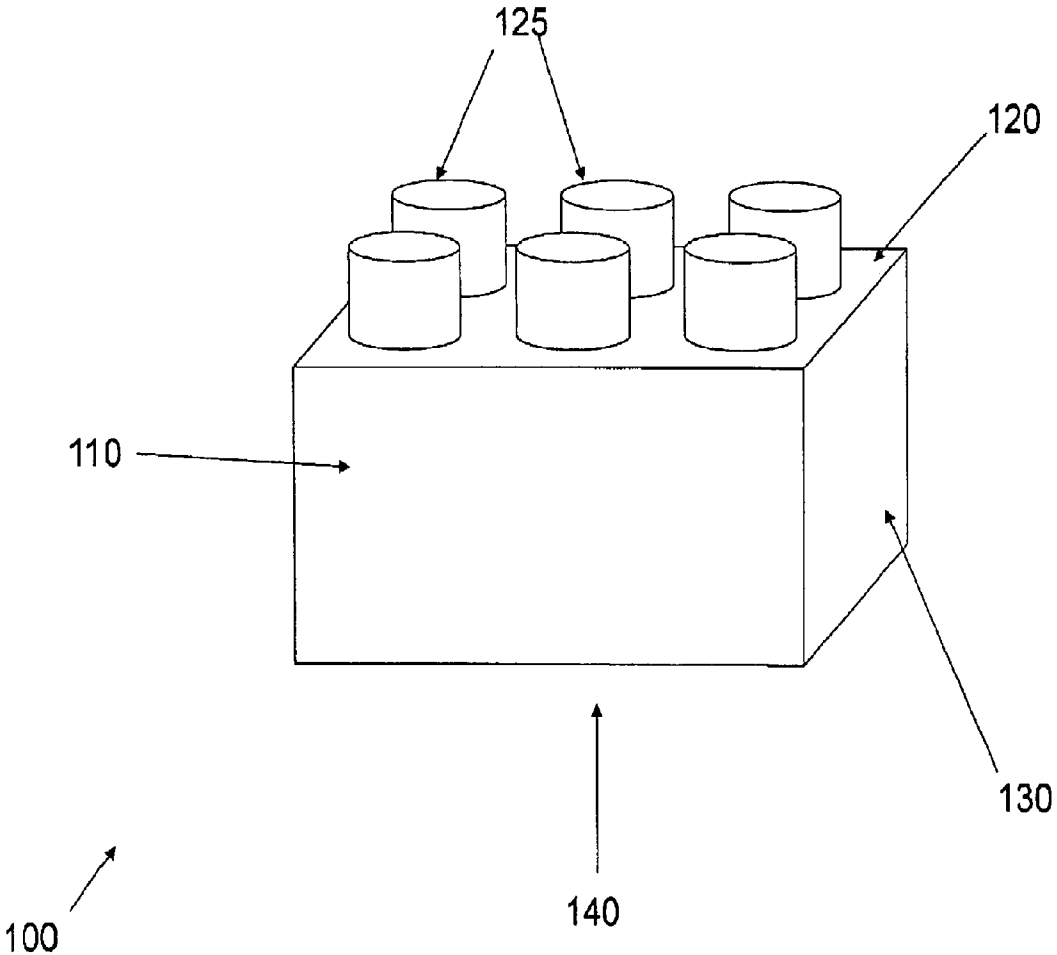
FIGS. 1A-1C are schematic views of building blocks according to some embodiments of the present invention.

For purposes of better understanding some embodiments of the present invention, as illustrated in FIGS. 1-10 of the drawings, reference is first made to FIG. 1A.

First Embodiment

FIG. 1A shows a building block 100 including an internal side 110 that faces inwards in a structure, an external side (not visible in figure), two joining sides 130 as well as a top side 120 including joining elements 125 and a bottom side 140. The block 100 may be made of any material, though polymers are preferred. The block is generally hollow in its construction and may be of any size or dimension desired. The joining elements 125 are shown here schematically and may be of number, shape, and size as required for optimal use. A block 100 is generally joined with identical blocks on its joining sides, where there may or may not be adhesive or other connection. Additional blocks may be attached from top and/or bottom through the agency of joining elements 125 so as to build up a wall of a building structure.

Figure 1B:
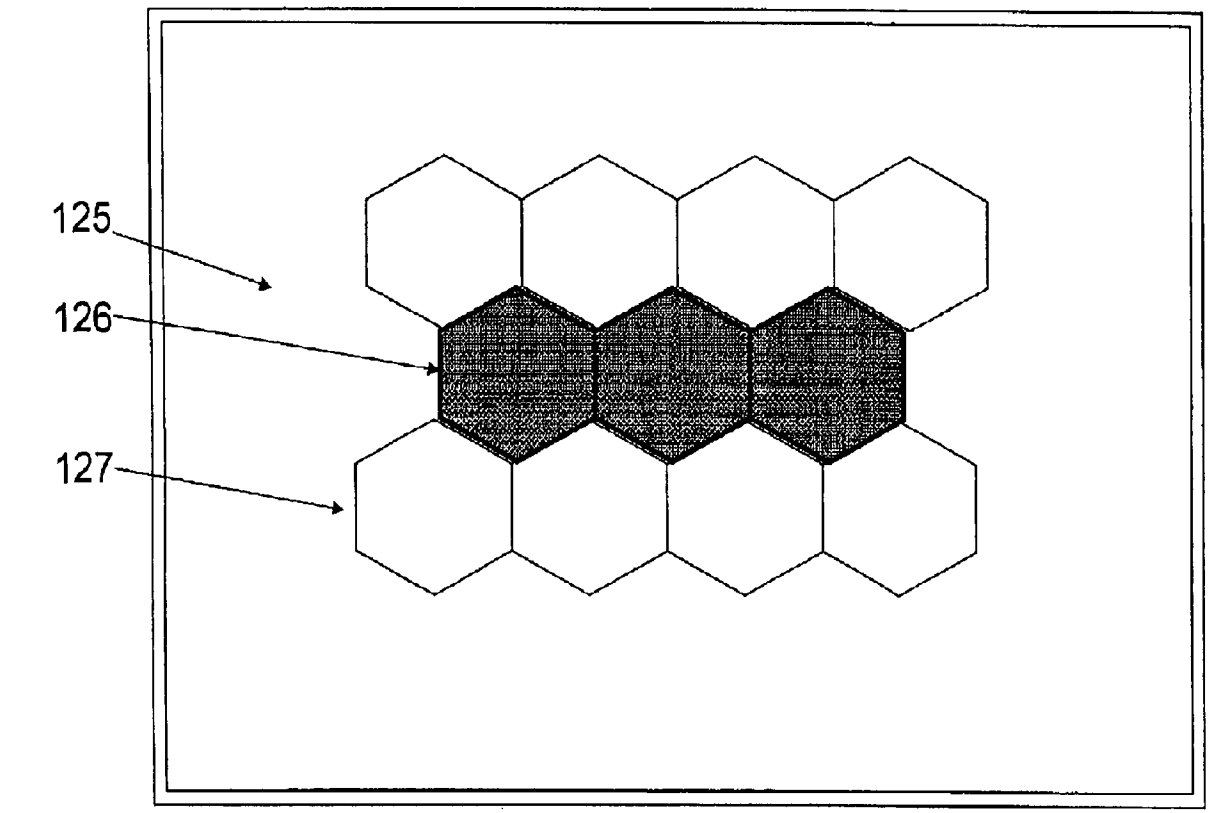
Figure 1C:
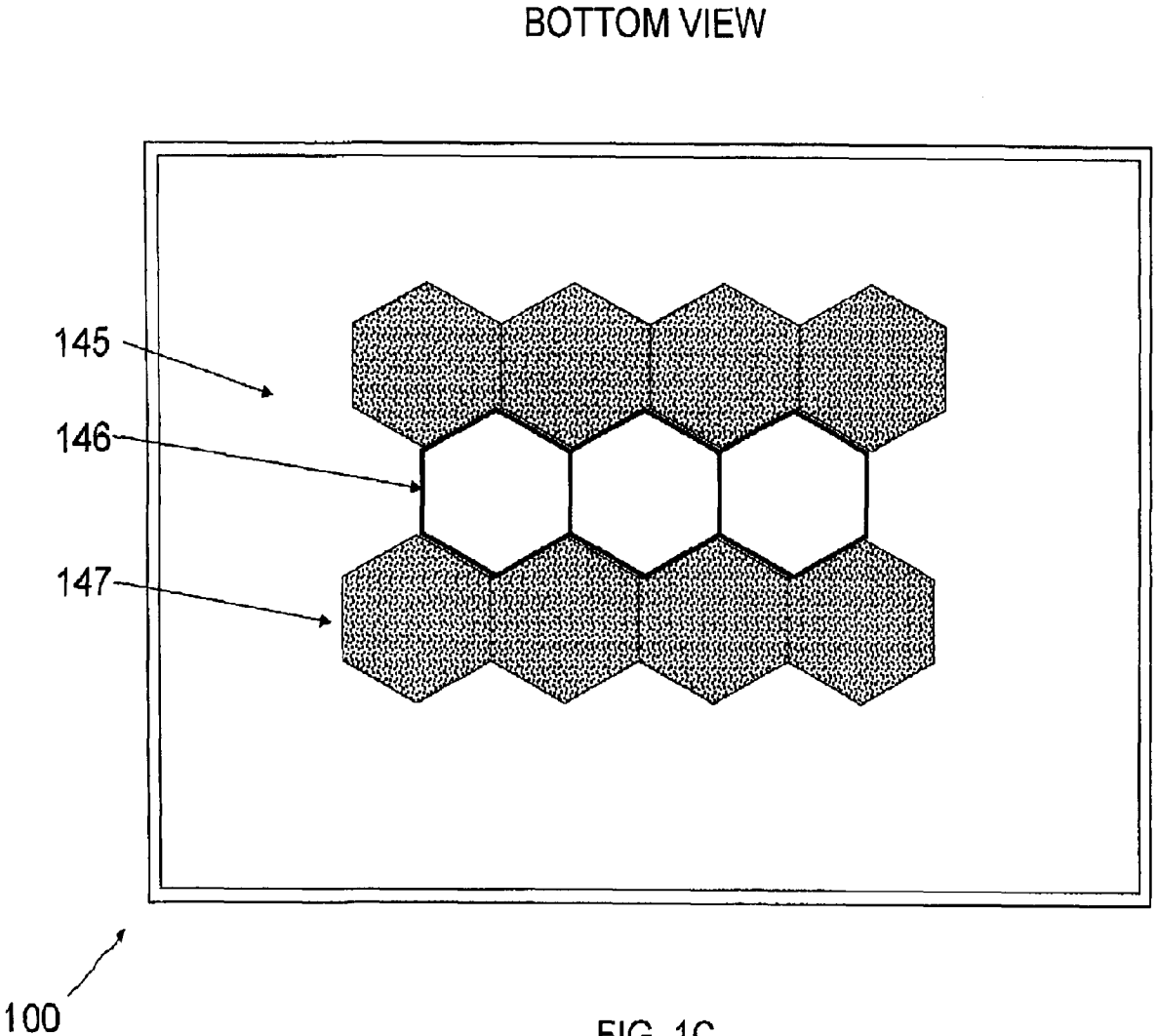

FIG. 1B shows a top view of a building block 100 in which the joining elements 125 are arranged in a honeycomb shape that includes protruding 126 and receding 127 elements. This physical arrangement allows for optimal joining of blocks 100, one on top of another. FIG. 1C shows a complementary bottom side 140 with joining elements 145 that are complementary to the joining elements (125, FIG. 1B) both in shape and physical arrangement. Namely, receding 146 and protruding 147 honeycomb elements allow for very tight block to block attachment.

Second Embodiment

Figure 2A:
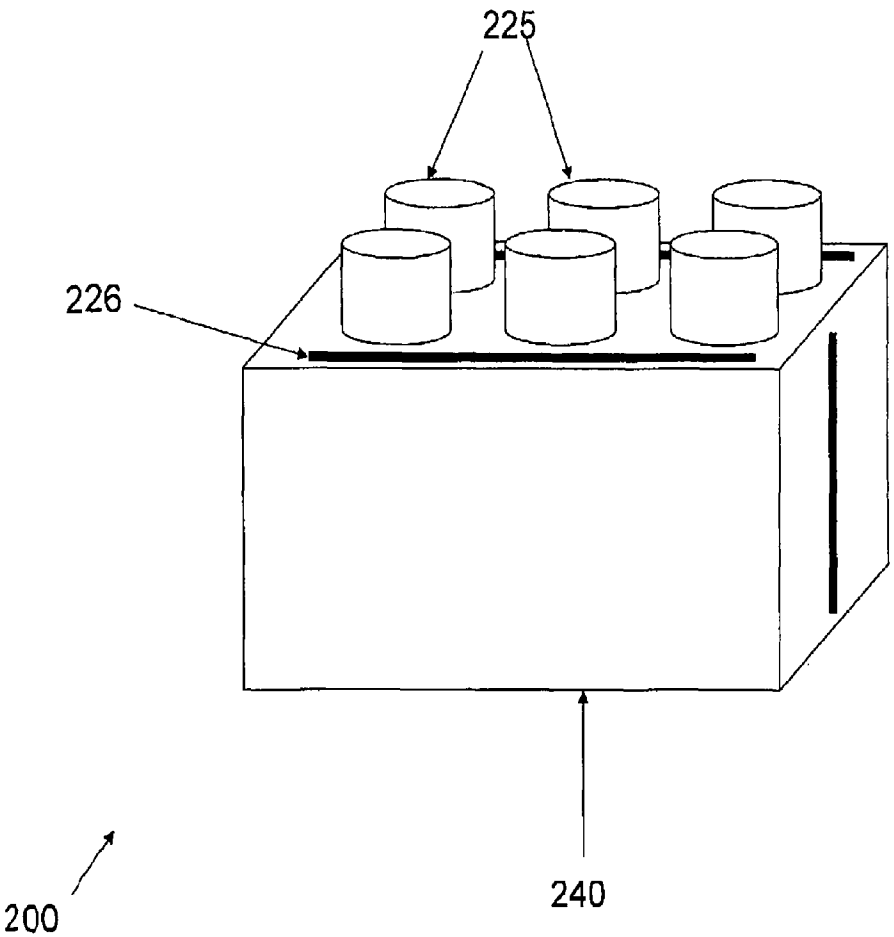
FIGS. 2A-2B are schematic views of an alternative embodiment of the present invention.
Figure 2B:
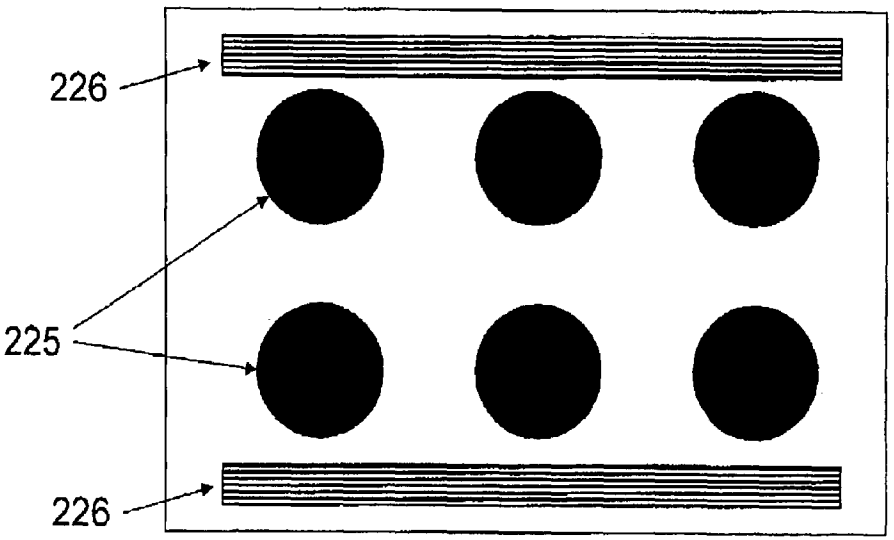

Attention is turned to FIG. 2A, which shows a building block 200 further including two-sided strong adhesive tape 226 applied to the top of said block 200 and in proximity to joining elements 225. The tape 226 is applied to the block 200 during manufacture and the second adhesive side of the tape 226 is exposed at a time of construction. Two sided tape 226 allows for very strong and nearly irreversible joining of building block 200 to a second building block (not shown). FIG. 2B shows a top view of the tape 226 as applied adjacent to joining elements 225. Two strips of tape are shown for example purposes only, and any number of pieces of tape of any appropriate size and dimensions may be utilized in the instant invention.

Figure 3:
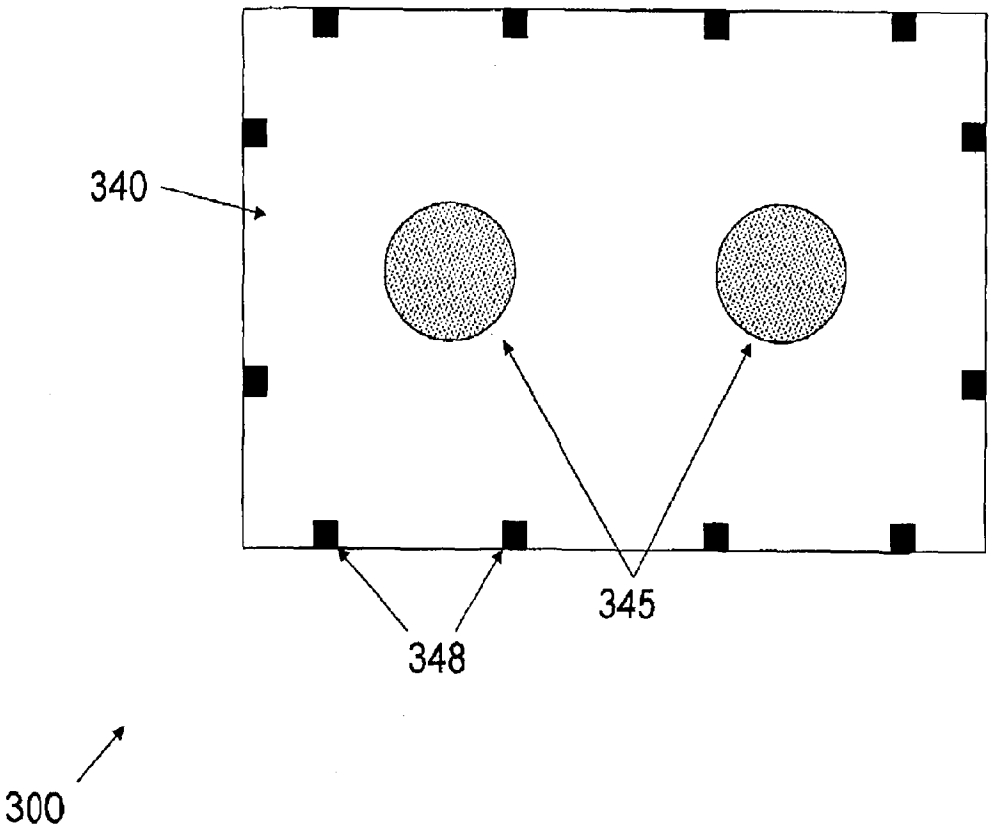
FIG. 3 shows a schematic bottom view of a building block according to an embodiment of the present invention.

Attention is now turned to FIG. 3 which shows a bottom 340 region of a building block 300 according to the present invention. The bottom 340 may include joining elements 325 as well as pins 348 or other elements that aid in either stabilizing block-block binding and/or allow for better fit between successive blocks. It is noted that the two-sided tape (226, FIG. 2) binds top and bottom (340, FIG. 3) regions of a block 300 in addition to joining elements which both join and align building blocks 300.

Third Embodiment

Figure 4:
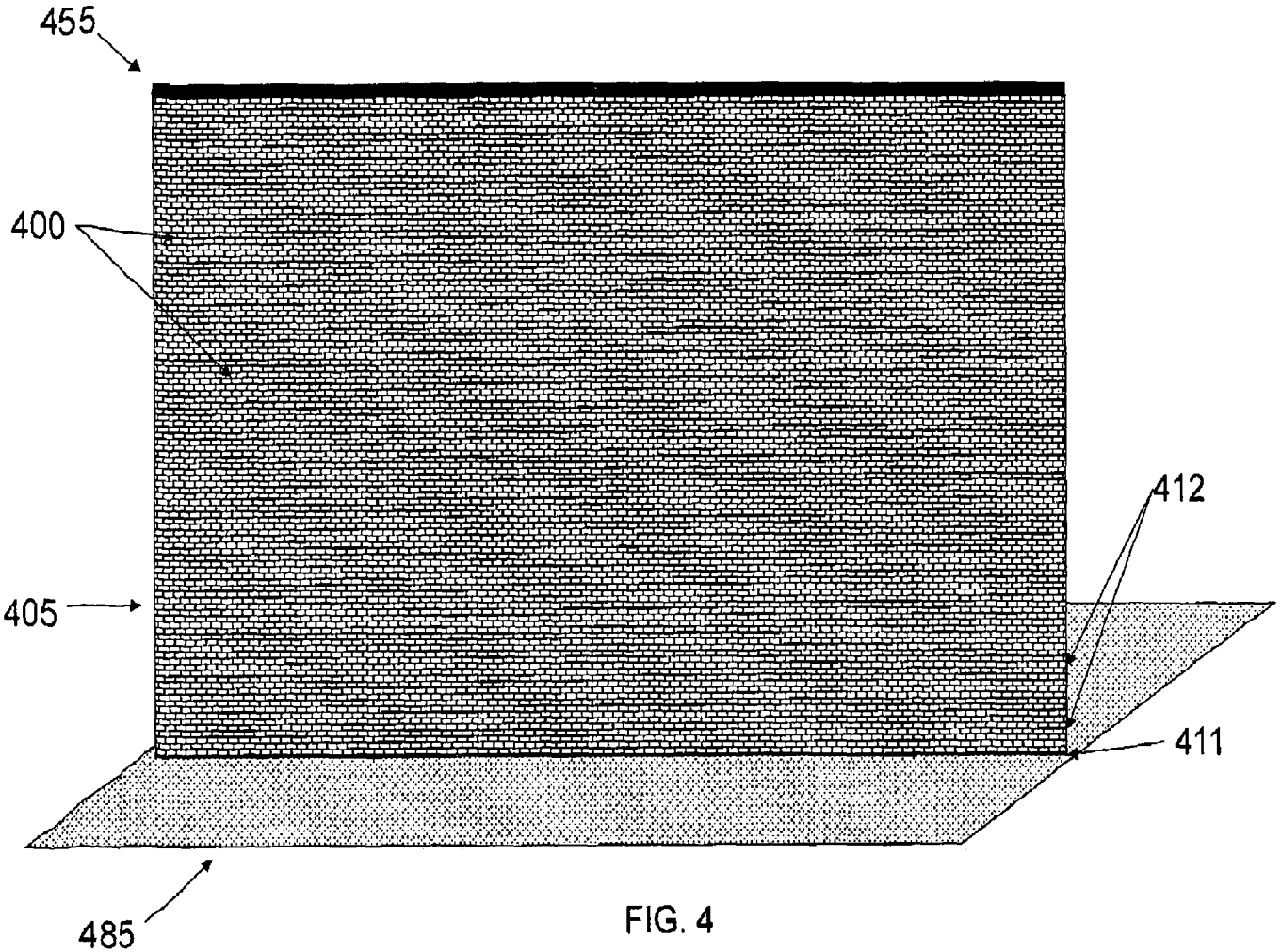
FIG. 4 shows a schematic view of a wall built with a plurality of building blocks prepared according to an embodiment of the present invention.

Attention is turned to FIG. 4. Blocks from the instant invention may be used in the construction of single-unit or multi-unit housing projects. In FIG. 4, a concrete foundation 485 is poured over a predetermined building area. Individual building blocks 400 are used to form a first row 411 of blocks 400. The blocks 400 can be secured to the concrete foundation 485 by any means including but not limited to two-sided tape. The blocks 400 of the first row 411 also can be held together through side-mounted double-sided tape (not shown) or other appropriate prefab binding elements. Additional rows 412 are added, with blocks from additional rows sitting above blocks 400. Joining elements as previous described assist in the tight linking of successive rows of blocks 400 to the desired height of the wall 405. At the top of the wall 405 is placed a closure element 455 which sits above the last row of blocks 400. The closure element 455 serves to secure the final row of blocks 400 and the entire wall 405 as constructed of individual prefab blocks 400. The wall 405 is just one part of a larger structure (not shown), but it is constructed without recourse to mortar. Additionally, the inner and outer surfaces are already painted or otherwise prepared so as to be in their final state. The wall 405, once constructed, requires no further treatment or manipulation.

Figure 5:
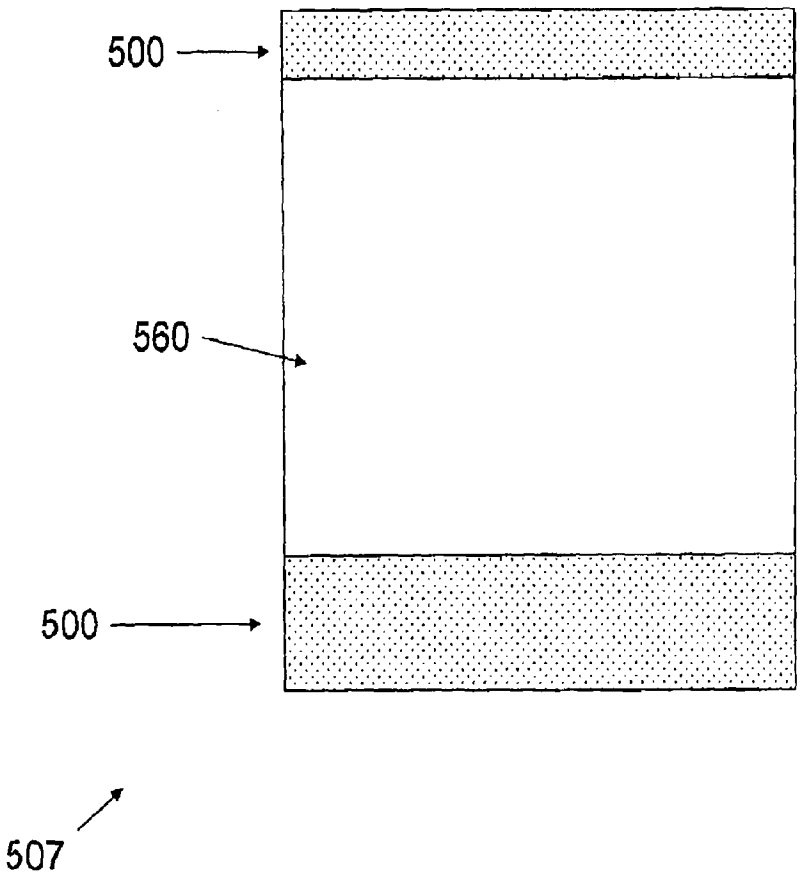
FIG. 5 shows a schematic view of unique inner and outer finishes on a building block according to an embodiment of the present invention.

Attention is turned to FIG. 5 which shows a window 507 as prepared according to the present invention. In the wall (FIG. 4, 405) previously described, no window was present. Obviously, any housing structure must have light and air access. Thus, windows, doors, and the like must be present. The window (FIG. 5, 507) may be built to any size or specification. Generally, there will be a block 500 on the bottom, glass 560 in the middle and another block 500 on the top. The blocks 500 do not have to be the same size or even of the same material. The glass 560 can be any appropriate material and may be tinted and/or have opening/closing features. The window 507 is integrated into a wall (not shown) through the attachment of the upper and lower blocks 500 to additional blocks (not shown) comprising the wall. Thus, windows, doors and other construction elements can be incorporated into buildings, whereby building blocks 500 are incorporated to facilitate insertion of windows, doors and the like into walls comprised of regular building blocks as described in FIGS. 1 & 2.

Fourth Embodiment

Figure 6A:
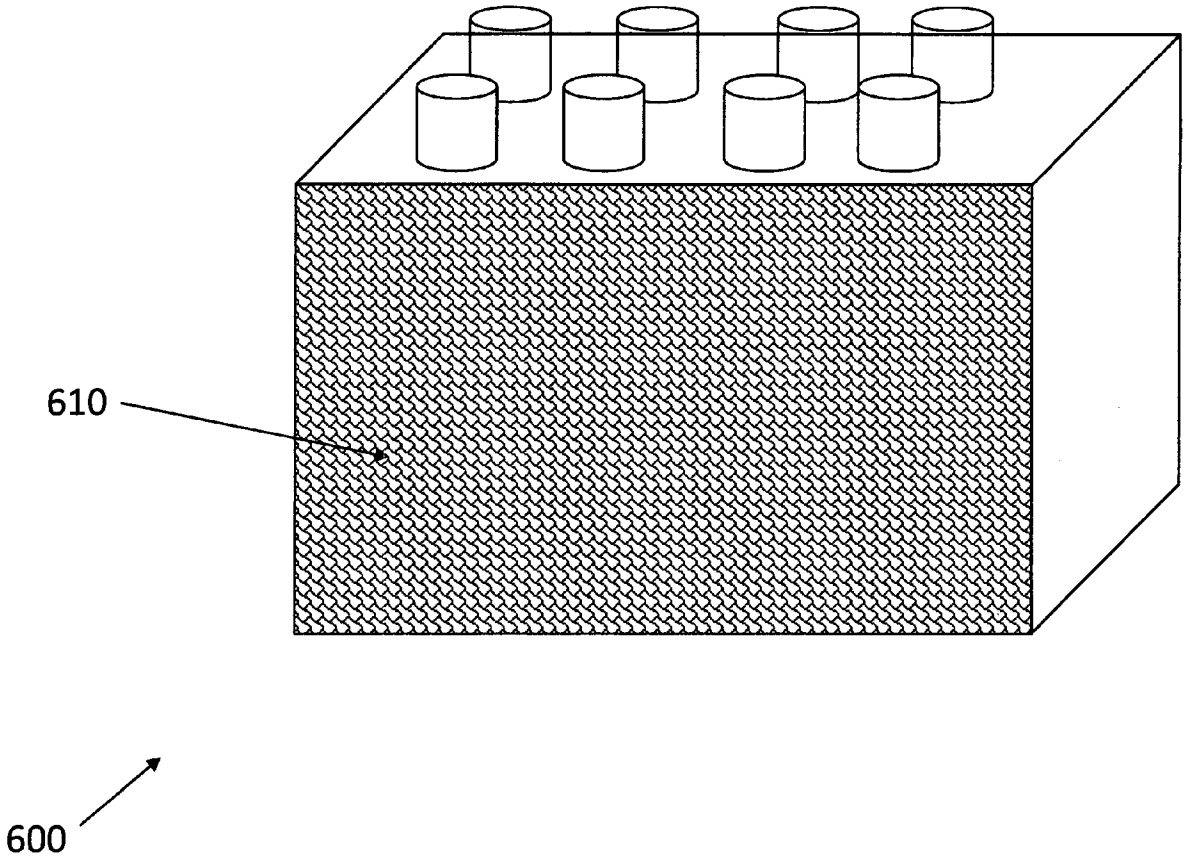
FIGS. 6A-6B show schematic views of a building block according to the instant invention and its prefab exterior surface.

Attention is turned to FIG. 6A which shows an embodiment of the present invention. A block 600 includes an inner coating 610 which is prepared prior to insertion of the block 600 into a building structure. The inner coating 610 may be paint, wall-paper, tiles, dry-board or any material used for decorative or functional purposes. By having an inner coating 610 present on block 600 prior to building, one does not require additional treatment of block 600 after construction. When construction is complete, a wall (not shown) has a complete, ready inner side that may appear painted, covered in wall-paper or otherwise decorated as a wall in a traditional house or building would be decorated.

Figure 6B:
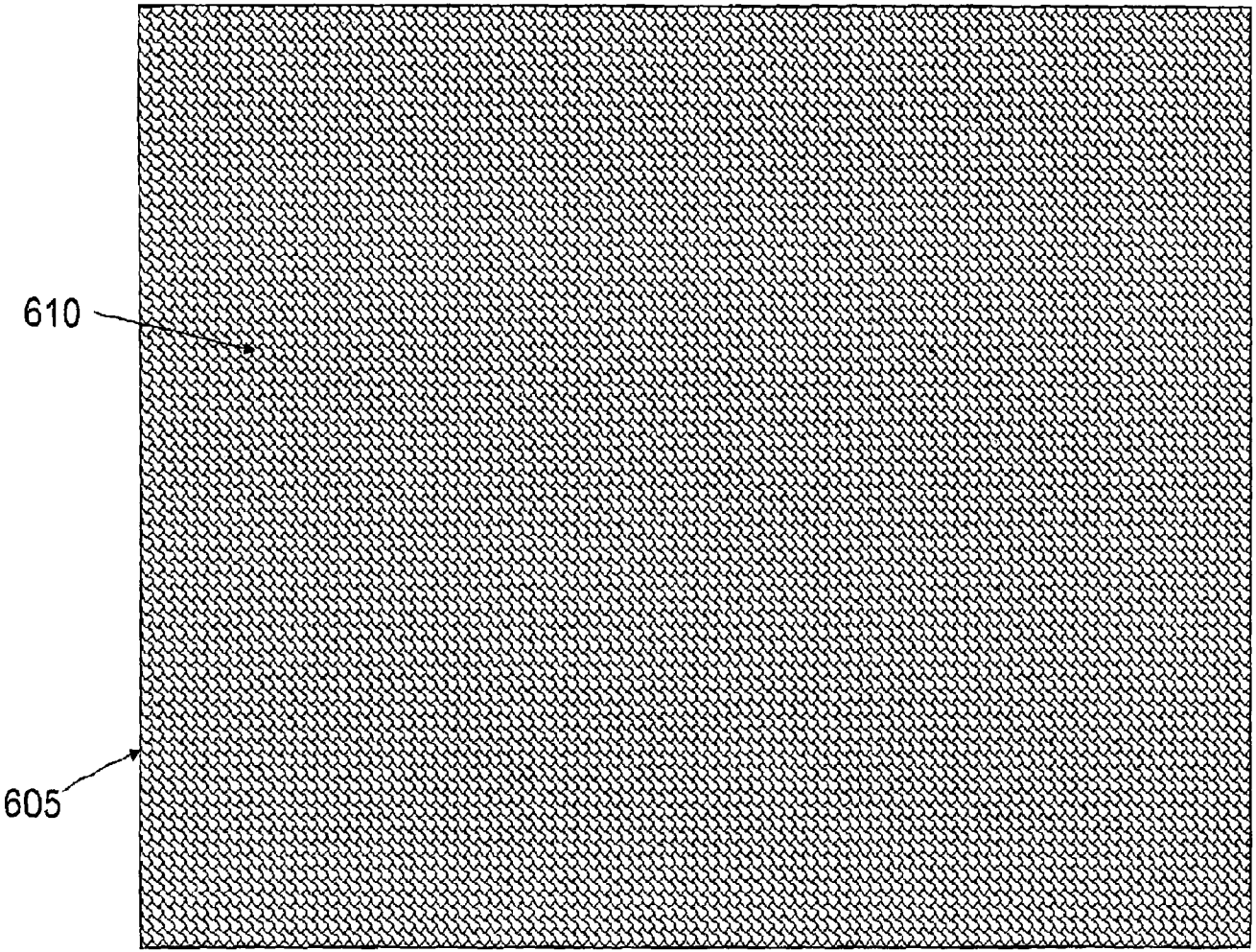

FIG. 6B shows a completed wall 605 with the inner coating 610 over the entire wall 605. In the figure, only one block type was used. It is obvious that a plurality of different blocks having different inner coatings may be employed to give predetermined designs or effects.

Figure 7A:
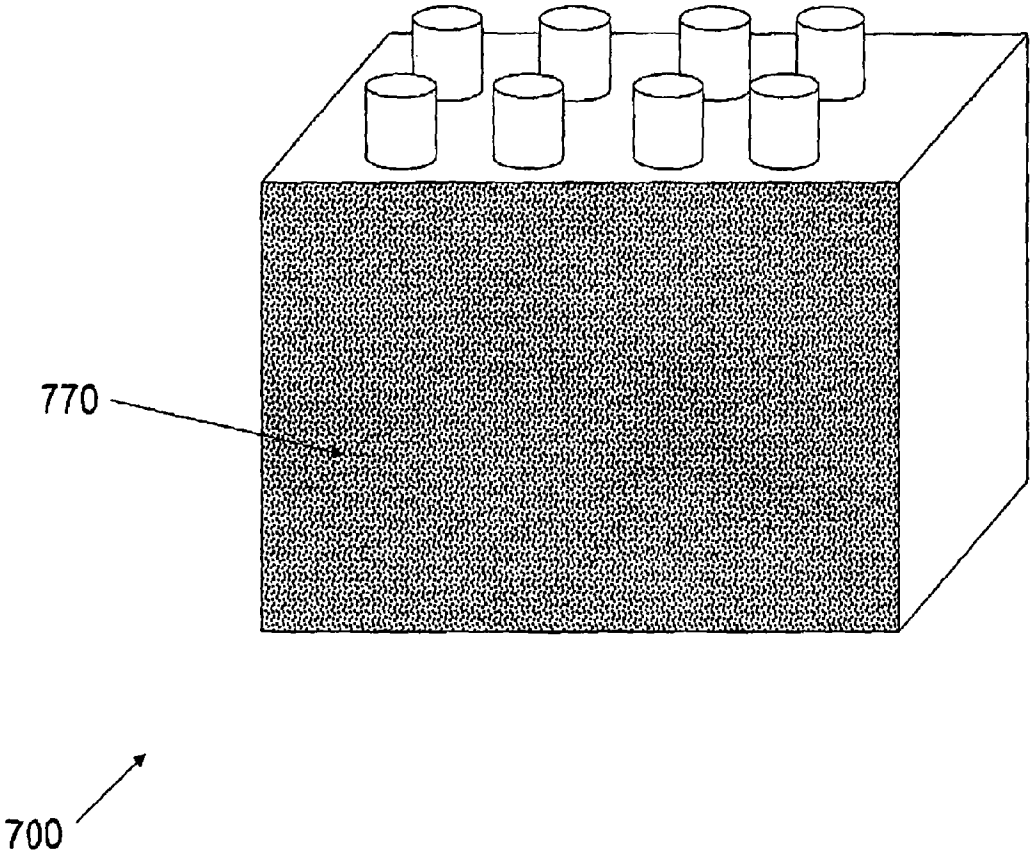
FIG. 7 shows a schematic view of a building block according to the instant invention and its prefab interior surface.
Figure 7B:
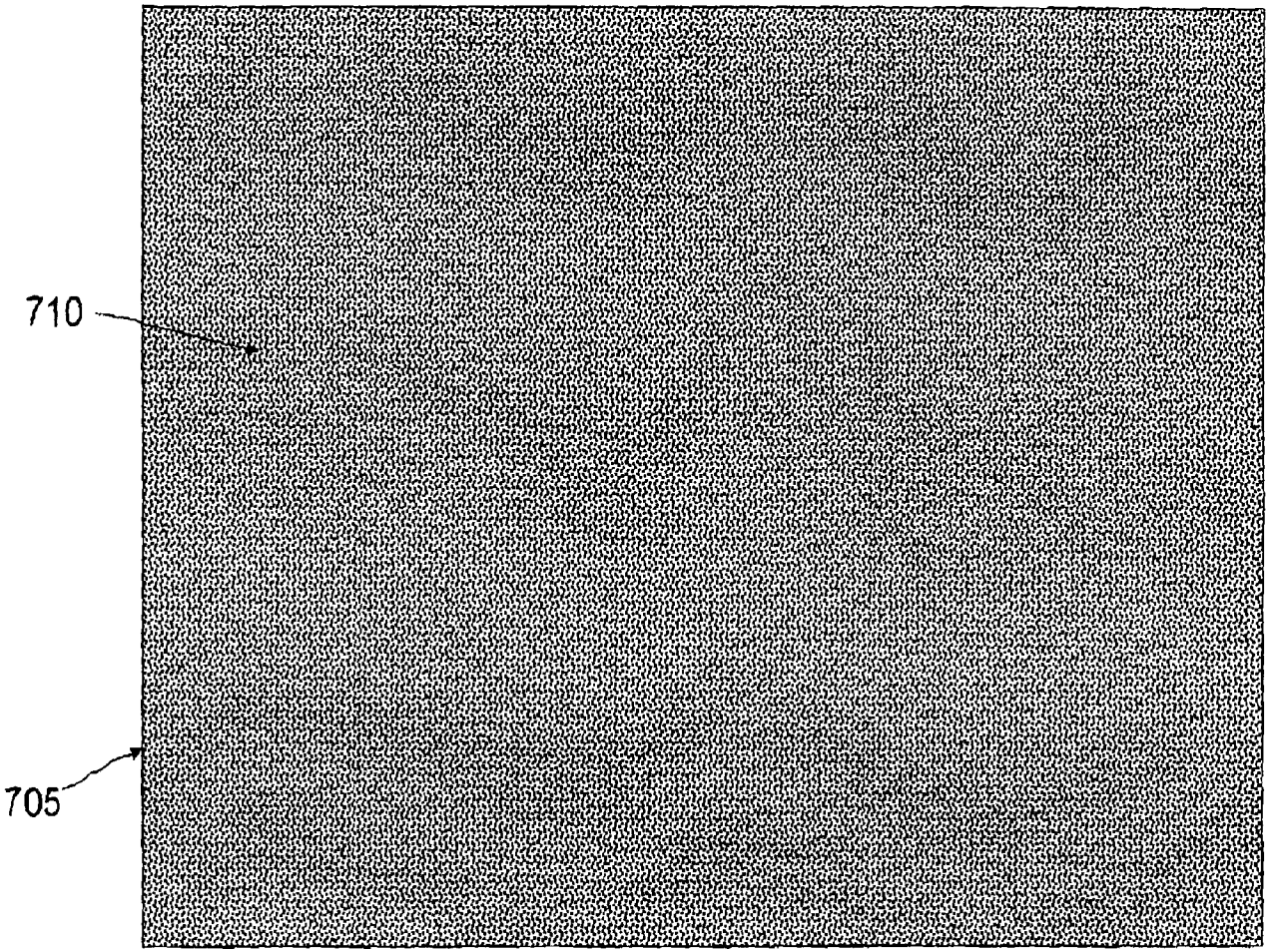

In FIG. 7A, one sees a schematic view of a block 700 which includes an outer coating 770 that is prepared prior to block 700 use and is generally made from materials that would be typically present on the outer face of a structure: paint, siding, stucco, brick facade, stone facade, wood, or the like. The block 700 is prepared with the outer coating 770 ready from the factory so that one hiring a builder would choose which outer coating he/she wishes to have at different points in the final, built structure (not shown). Ostensibly, a builder would have a catalogue of standard production blocks 700 that are available with a wide range of different outer coatings 770 and inner coatings (FIG. 6B, 610). A consumer or client would choose the inner and outer coatings desired either for the entire structure or in a room-by-room manner and the supplier or contractor would deliver for use ready pre-made blocks that have full construction capability as well as the desired inner and outer finishes. As such, no mortar, paint, siding, wallpaper or the like must be used after construction. After building has been completed, no further finishing work is required. Obviously, if one wishes to add paint, wallpaper or the like, he/she can do so. But with the instant invention, there would be no further requirement to do so. FIG. 7B shows a final wall 705 with a complete outer coating. While the lines between blocks (not shown) might be visible, the engineering of the blocks allows for minimization of the lines between blocks or their cover with the outer coating or inner coating (FIG. 6B, 610).

Fifth Embodiment

Figure 8A:
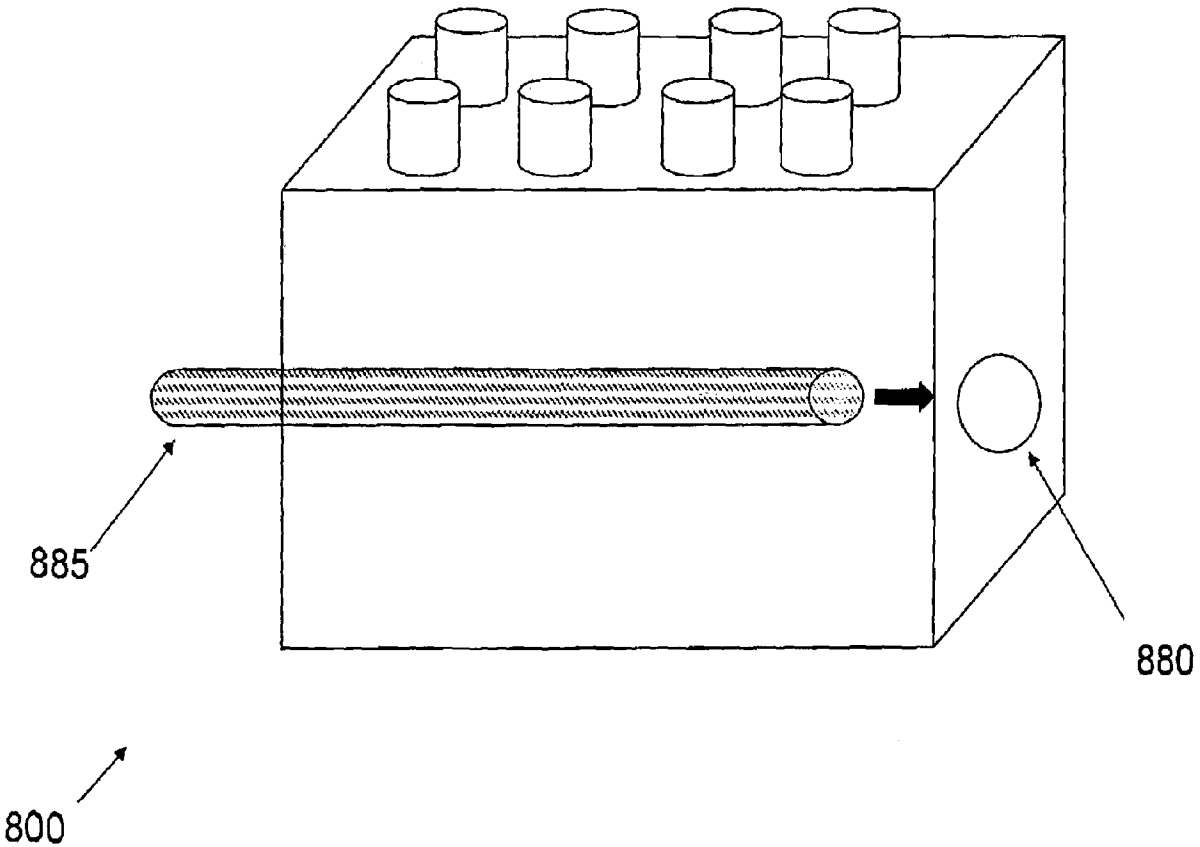

Attention is now turned to FIG. 8A which shows a schematic view of an embodiment of the present invention. A block 800 is adapted to allow for passage of infrastructure element 885 between blocks and through a final wall. Infrastructure elements may include but are not limited to electrical wiring, water or steam pipes, Internet or phone wires, cables or the like. Such elements are generally run through the floor, walls, or ceiling and as such a block 800 may be adapted through appropriate holes 880 or the like to allow for passage of infrastructure element 885. When a final wall is constructed (not shown), the holes 880 are not visible as they stand between blocks and are not visible either on the inside or the outside of the final structure.

Figure 8B:
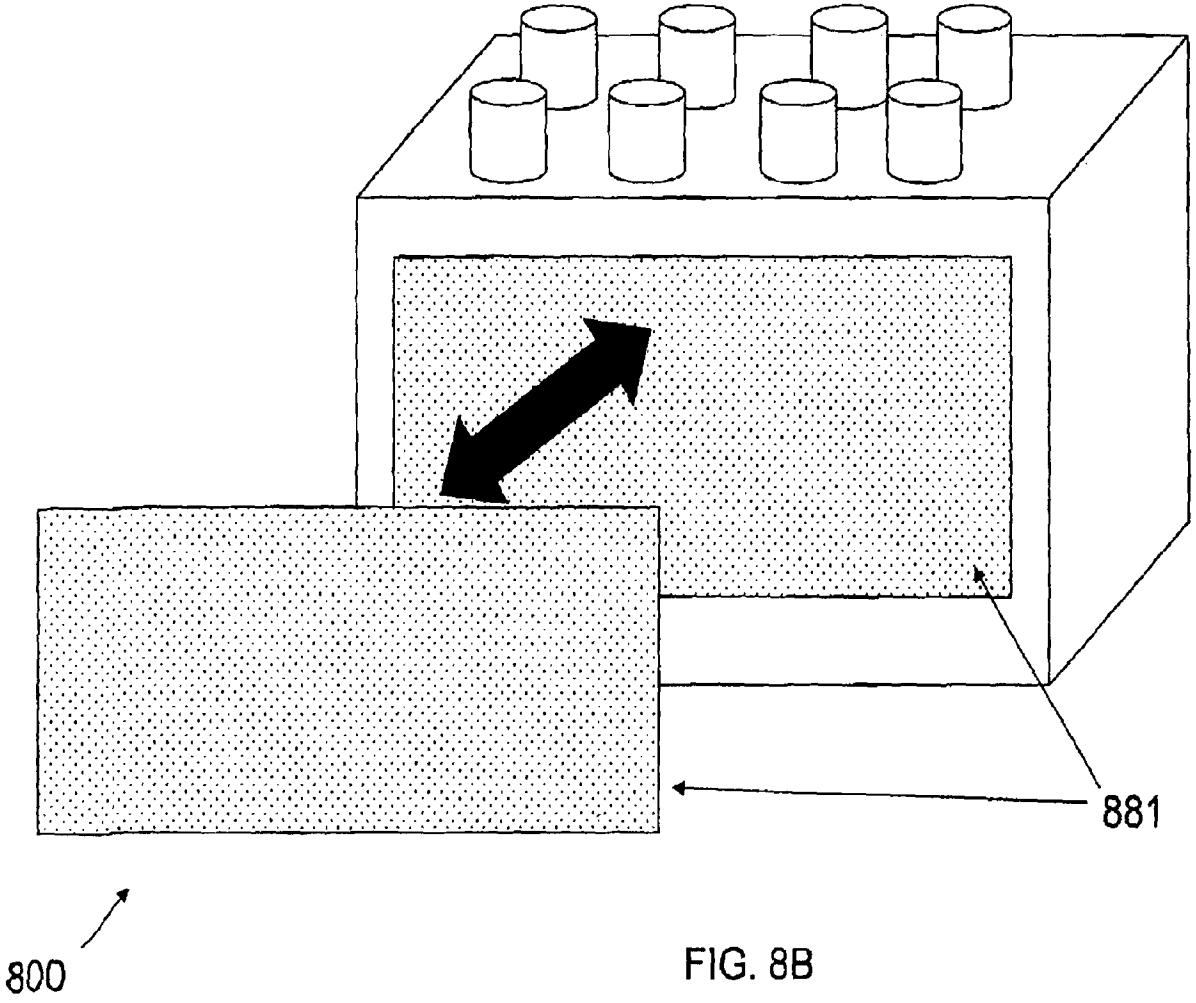
Figure 8C:
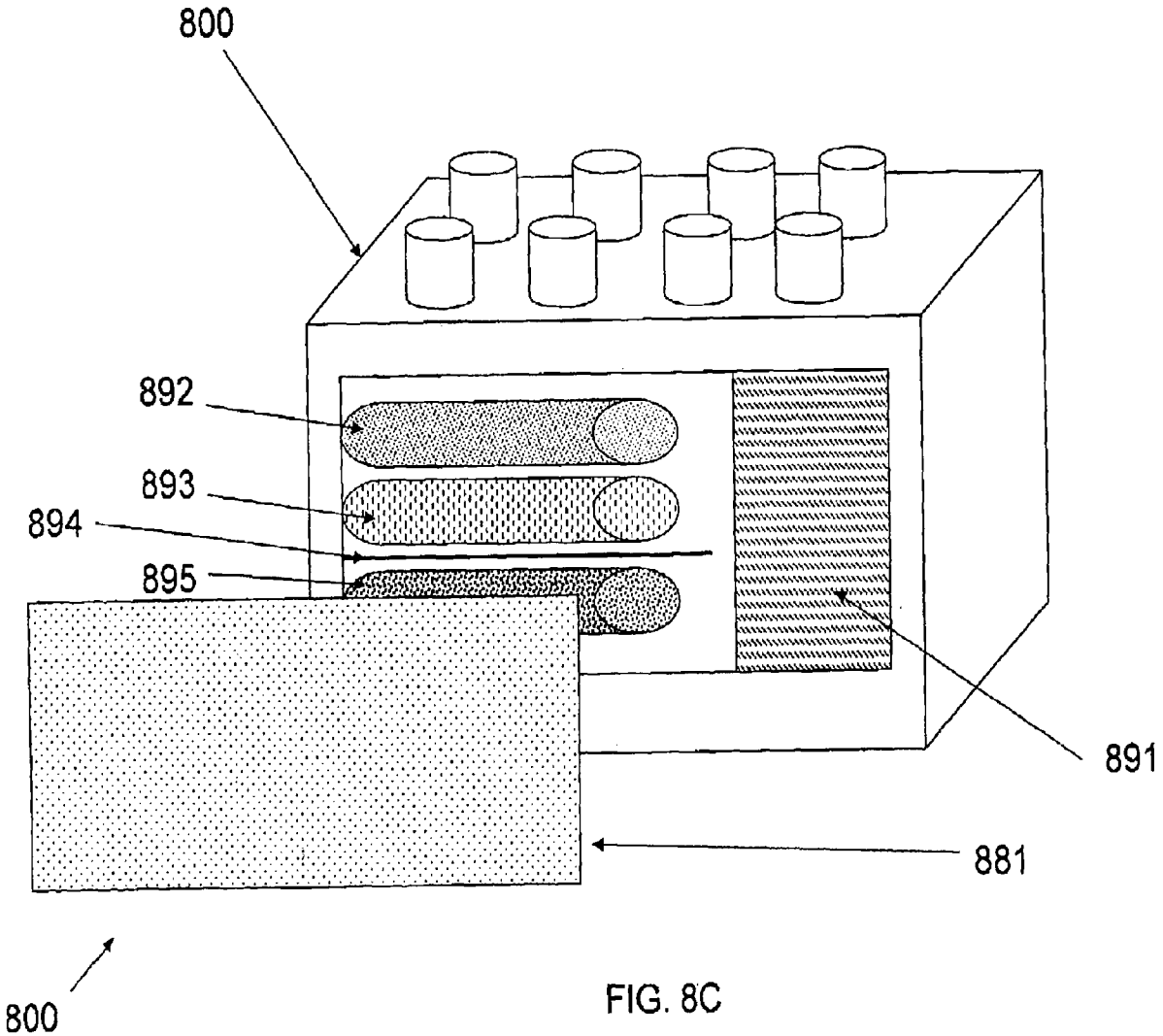
FIG. 8C shows a schematic view of a block according to an embodiment of the invention, wherein insulation and various forms of infrastructure elements may be seen in the internal space of the block.
Figure 8D:
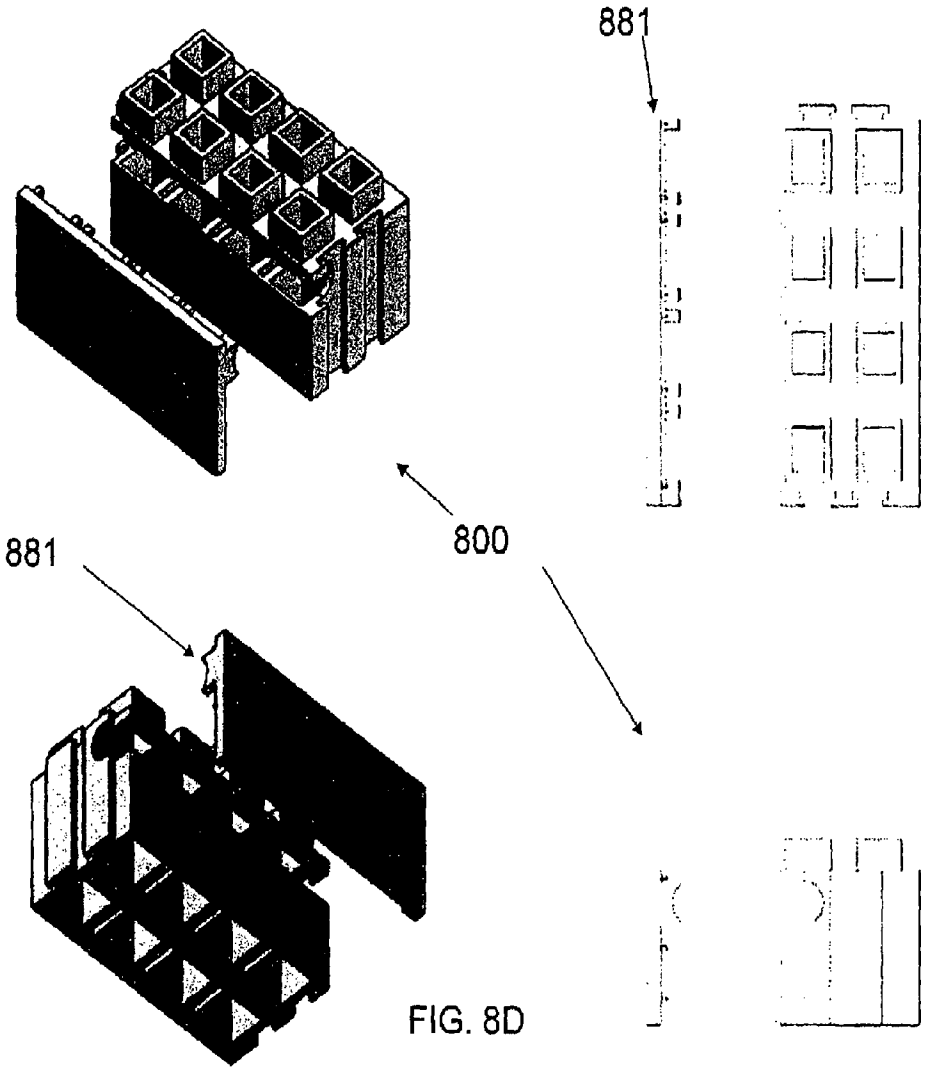

Attention is now turned to FIG. 8B which shows a schematic view of an alternative embodiment of the invention. A removable face 881 is included in a block 800 and serves to allow for insertion of pipes, wires, and other infrastructure elements (not shown in this view). The door 881 may be attached by any means including but not limited to screws or adhesive. The door is removed, wires, pipes, cables and the like are entered and then face 881 is replaced to its original position. It is expected that a subset of all blocks used in a construction job will require space for pipes, wires and the like and such blocks will have a capability as shown in FIGS. 8A-8B to seamlessly handle such elements.

Should floors be built by similar block methods, they too can include either holes and/or removable elements to receive wires and piping that traditionally are laid beneath floors during construction. The same would apply to ceilings built by the block methods described for the present invention.

It is understood from the embodiments of the present invention that blocks 800 may be made of any size or shape that is relevant for an appropriate construction job. Blocks may be made of various sizes and also appropriate shapes to allow for corner construction. Thus, L-shaped blocks or blocks built at 90 degrees may be used to affect corner construction within the embodiments of the present invention. Blocks may be made of any materials, including but not limited to polymers, stone, metals, wood, concrete, or composites.

Figure 9:
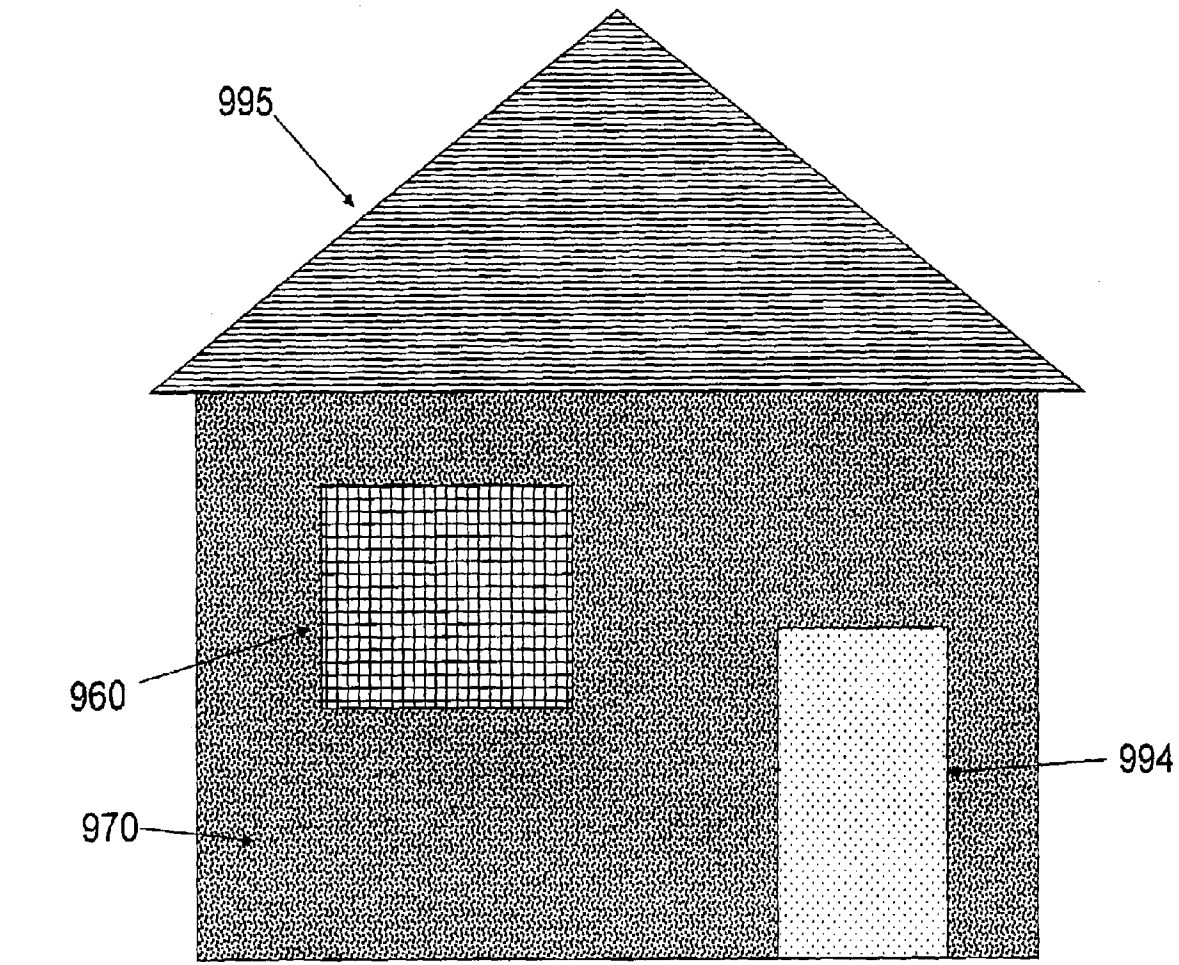
FIG. 9 shows a schematic view of a house built with blocks according to an embodiment of the present invention; and, FIG. 10 shows a flowchart associated with a method of the present invention.

Attention is turned to FIG. 9 which shows a schematic view of a house 990 built according to an embodiment of the present invention. Blocks are used for construction of wall 905, window 960, door 990 and roof 995. The blocks selected for each element may be the same or different. The blocks are designed to allow for facile incorporation of elements such as windows, doors, and the like into larger structures such as walls based on the blocks. Of the advantages of the instant invention, there are the ease and speed with which construction is performed: blocks are brought to a building site and the blocks are appropriately assembled to yield a final structure. No mortar is required and after building, the walls and other elements are complete, with no need for further painting or treatment. The wall 905 has the outer coating 970 which is complete and ready to withstand the elements. Blocks fit well enough together to prevent wind, rain, and bugs from entering inside the structure. The first and second finishes associated with a block are complete, in the sense that they require no further treatment or modification.

Sixth Embodiment

Figure 10:
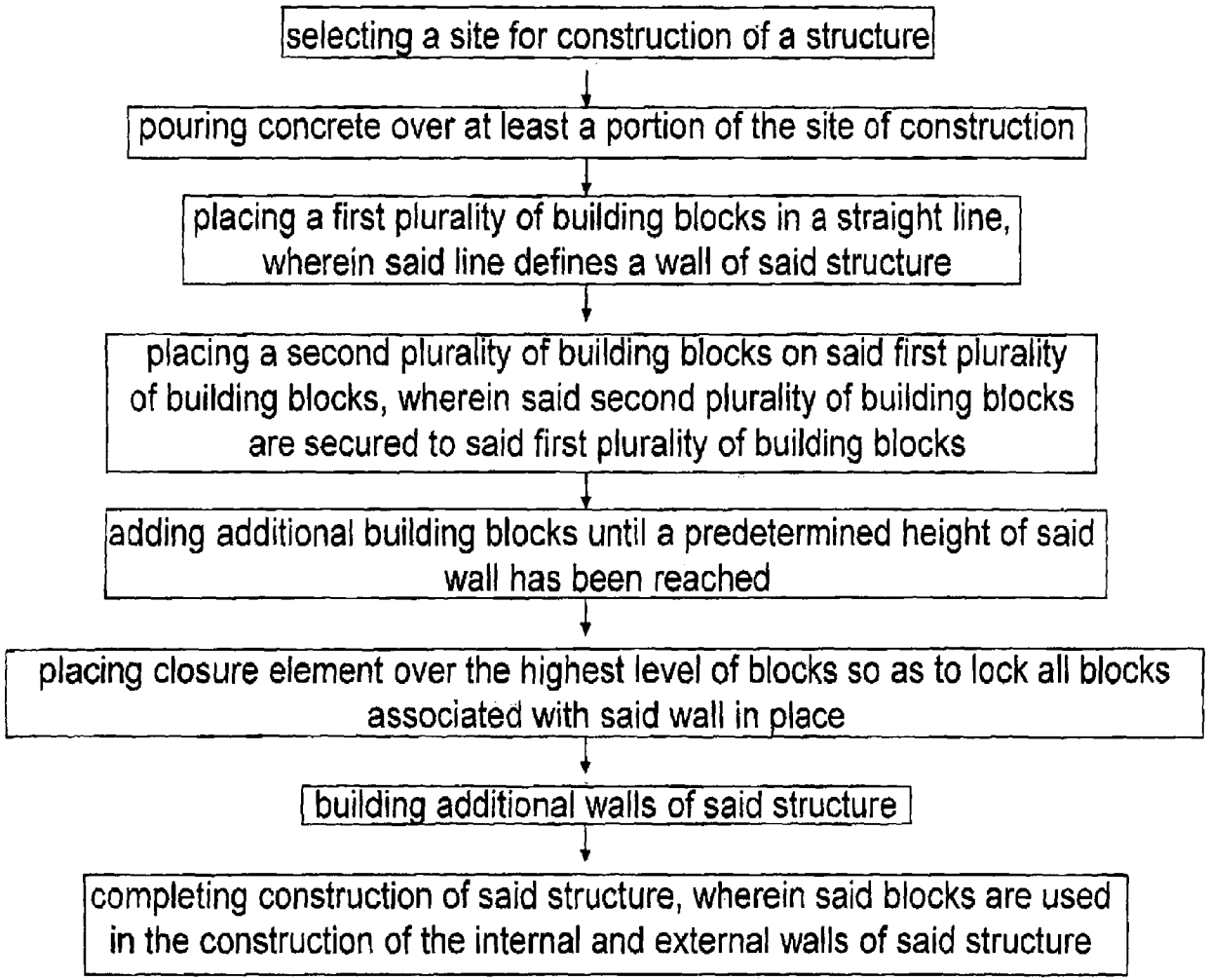

Attention is turned to FIG. 10 which shows a method associated with the present invention. In the method, a site is selected for construction of a structure. The structure can be private or public, large or small, of any shape, with unique finishes outside and inside. After selection of site, the site is leveled and concrete is poured over all or part of the site. Infrastructure elements such as piping for hot and cold water may be encased in the poured concrete. Above the poured concrete, walls of the structure are built, namely by first placing a plurality of building blocks in a straight line or in any shape that reflects the intended final shape of the structure. The first row of blocks is placed on the concrete (or other base material) as previously described. A second, third and additional pluralities of building blocks are sequentially placed over the first row of blocks, blocks being attached top-to-bottom and side-to-side as previously described. Additional rows of blocks are placed to the final desired height of any given wall. After a wall is completed, a closure element may be placed to secure and complete a wall. Additional walls of the structure are built in a similar manner until the structure's outer and inner walls/divisions are complete. Infrastructure elements may be run through the blocks of the wall.

It is expected that during the life of a patent maturing from this application variable mold technologies will be developed and the scope of the term of the invention is intended to include all such new technologies a priori.

As used herein the term "about" refers to ±10%.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

All technical terms may have their normal meaning as applied to the art unless otherwise specified. "Infrastructure elements" may refer to cables, pipes, wires, and the like traditionally used in construction. Such cables, pipes, and wires may move water, telephone connections, electricity, TV connections or other items.

EXAMPLE

Blocks are produced from polymeric material from a three-dimensional printer to final dimensions of 50/60 centimeters in length, 25/30 centimeters height, and 5/10/20 centimeters in width. The blocks are hollow and have multiple holes for the passage of wires and pipes. The blocks additionally include insulation made from fiberglass. A subset of the blocks include a removable wall that allows for insertion of piping and electrical/phone cables; the removable wall is placed over the piping and cables and may be removed in order to service said piping and cables. The blocks may be used as they are produced in the production of walls of a structure or alternatively, the blocks may be painted and or treated to create unique inner and outer finishes prior to use of blocks in construction of a plurality of walls in a structure. The finishes may be bonded, glued, or otherwise associated with the blocks.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination. Insulation, electronic components or other items may be included in the inside our outside of a block. Additionally, one could paint or otherwise treat a block after building, should he/she wish. Such additional treatment would not be required but could be done.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. The present invention could be employed for production of wide variety of "building blocks" of non-rectangular shapes and for uses beyond traditional building.

Various embodiments and aspects of the present invention as delineated hereinabove and as claimed in the claims section below find experimental support in the following example.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A composite material block for the mortar-less construction of a building, wherein said block has a top side that includes a first joining feature made of said composite material, a bottom side including a complementary second joining feature adapted to receive the first joining feature, an outer side having a first unique finish, an inner side having a second unique finish different from said first unique finish, and an inner space running a length of the block and adapted to the passage of infrastructure elements between adjacent blocks, wherein said inner space ends in two open holes located on ends of said block and is formed on one side by a composite material removable face , wherein said face is adapted to be completely detachable from and returnable to said block by means of screws or adhesives.

2. The block according to claim 1, wherein said first joining feature is a plurality of joining features.

3. The block according to claim 1, wherein said second joining feature is a plurality of joining features.

4. The block according to claim 3, wherein said joining features include at least one strip of two-sided tape.

5. The block according to claim 1, wherein said first joining feature and said second joining feature include at least one male joining feature and at least one female joining feature.

6. A concrete block for the mortar-less construction of a building, wherein said block has a top side that includes a first joining feature made of said concrete, a bottom side including a complementary second joining feature adapted to receive the first joining feature, an outer side having a first unique finish, an inner side having a second unique finish different from said first unique finish, and an inner space running a length of the block and adapted to the passage of infrastructure elements between adjacent blocks, wherein said inner space ends in two open holes located on ends of said block and is formed on one side by a concrete removable face , wherein said face is adapted to be completely detachable from and returnable to said block by means of screws or adhesives.

7. The block according to claim 6, wherein said building is a house, room, office, factory, school, hospital, public structure, private building or room.

8. The block according to claim 6, further including insulation placed inside said block in said inner space.

9. The block according to claim 6, wherein said infrastructure elements are selected from piping, wiring, cables, or telephone lines.

10. The block according to claim 6, wherein said first finish is weatherproofed and selected from paint, wood, brick, aluminum siding, stone, glass, composite materials, metal.

* * * * *